US010979839B2

(12) United States Patent
Ukai et al.

(10) Patent No.: US 10,979,839 B2
(45) **Date of Patent: *Apr. 13, 2021**

(54) SOUND PICKUP DEVICE AND SOUND PICKUP METHOD

(71) Applicant: Yamaha Corporation, Hamamatsu (JP)

(72) Inventors: Satoshi Ukai, Waltham, MA (US); Tetsuto Kawai, Hamamatsu (JP); Mikio Muramatsu, Fukuroi (JP); Takayuki Inoue, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/578,493

(22) Filed: Sep. 23, 2019

(65) Prior Publication Data

US 2020/0021932 A1 Jan. 16, 2020

Related U.S. Application Data

(63) Continuation of application No. PCT/JP2017/012071, filed on Mar. 24, 2017.

(51) Int. Cl.
*H04R 29/00* (2006.01)
*H04R 3/00* (2006.01)
*H04R 1/40* (2006.01)

(52) U.S. Cl.
CPC ..... *H04R 29/006* (2013.01); *H04R 1/406* (2013.01); *H04R 3/005* (2013.01); *H04R 2410/01* (2013.01)

(58) Field of Classification Search
CPC ..... H04R 29/006; H04R 1/406; H04R 3/005; H04R 2410/01
See application file for complete search history.

(56) References Cited

U.S. PATENT DOCUMENTS

| | | | | |
|---|---|---|---|---|
| 7,171,008 | B2 * | 1/2007 | Elko | H04R 3/005 381/122 |
| 7,174,022 | B1 | 2/2007 | Zhang et al. | |
| 7,561,700 | B1 * | 7/2009 | Bernardi | H04R 3/005 381/313 |
| 2005/0074129 | A1 | 4/2005 | Fan | |
| 2008/0226098 | A1 * | 9/2008 | Haulick | H04R 3/005 381/94.9 |
| 2008/0317261 | A1 | 12/2008 | Yoshida et al. | |

(Continued)

FOREIGN PATENT DOCUMENTS

| | | |
|---|---|---|
| JP | 62-7298 A | 1/1987 |
| JP | 6-67691 A | 3/1994 |

(Continued)

OTHER PUBLICATIONS

International Search Report (PCT/ISA/210) issued in PCT Application No. PCT/JP2017/012071 dated May 23, 2017 with English translation (four (4) pages).

(Continued)

*Primary Examiner* — Andrew L Sniezek
(74) *Attorney, Agent, or Firm* — Crowell & Moring LLP

(57) ABSTRACT

A sound pickup method obtains a correlation between a first sound pickup signal of a directional first microphone and a second sound pickup signal of a non-directional second microphone, and performs level control of the first sound pickup signal or the second sound pickup signal according to a calculation result of the correlation.

19 Claims, 11 Drawing Sheets

(56) References Cited

U.S. PATENT DOCUMENTS

| | | | | |
|---|---|---|---|---|
| 2011/0313763 | A1 | 12/2011 | Amada | |
| 2013/0066628 | A1 | 3/2013 | Takahashi | |
| 2014/0376744 | A1* | 12/2014 | Hetherington | H03G 3/20 381/94.2 |
| 2015/0281834 | A1* | 10/2015 | Takano | H04R 3/005 381/92 |
| 2015/0294674 | A1* | 10/2015 | Takahashi | G10L 25/03 704/226 |
| 2016/0073203 | A1 | 3/2016 | Kuriger | |
| 2019/0116422 | A1* | 4/2019 | Song | H04R 3/04 |
| 2020/0021932 | A1 | 1/2020 | Ukai et al. | |

FOREIGN PATENT DOCUMENTS

| | | | |
|---|---|---|---|
| JP | 11-18193 | A | 1/1999 |
| JP | 2004-289762 | A | 10/2004 |
| JP | 2006-129434 | A | 5/2006 |
| JP | 2009-5133 | A | 1/2009 |
| JP | 2013-61421 | A | 4/2013 |
| JP | 2015-194753 | A | 11/2015 |
| JP | 2016-42613 | A | 3/2016 |

OTHER PUBLICATIONS

Japanese-language Written Opinion (PCT/ISA/237) issued in PCT Application No. PCT/JP2017/012071 dated May 23, 2017 (four (4) pages).

Japanese-language Office Action issued in Japanese Application No. 2019-506898 dated Jun. 23, 2020 with English translation (six pages).

Partial Supplementary European Search Report issued in European Application No. 17901438.6 dated Aug. 31, 2020 (14 pages).

International Search Report (PCT/ISA/210) issued in PCT Application No. PCT/JP2018/011318 dated May 15, 2018 with English translation (four pages).

U.S. Office Action issued in U.S. Appl. No. 16/572,825 dated May 19, 2020 (19 pages).

Partial Supplementary European Search Report issued in European Application No. 18772153.5 dated Aug. 21, 2020 (12 pages).

Japanese-language Office Action issued in Japanese Application No. 2019-506958 dated Nov. 10, 2020 with English translation (13 pages).

Chinese-language Office Action issued in Chinese Application No. 201780088827.4 dated Nov. 26, 2020 with partial English translation (14 pages).

* cited by examiner

SOUND PICKUP DEVICE AND SOUND PICKUP METHOD

CROSS REFERENCE TO RELATED APPLICATIONS

The present application is a continuation of International Application No. PCT/JP2017/012071, filed on Mar. 24, 2017, the entire content of which is incorporated herein by reference.

BACKGROUND OF THE INVENTION

1. Field of the Invention

A preferred embodiment of the present invention relates to a sound pickup device and a sound pickup method that obtain sound from a sound source by using a microphone.

2. Description of the Related Art

Japanese Unexamined Patent Application Publication No. 2016-042613, Japanese Unexamined Patent Application Publication No. 2013-061421, and Japanese Unexamined Patent Application Publication No. 2006-129434 disclose a technique to obtain coherence of two microphones, and emphasize a target sound such as voice of a speaker.

For example, the technique of Japanese Unexamined Patent Application Publication No. 2013-061421 obtains an average coherence of two signals by using two non-directional microphones and determines whether or not sound is a target sound based on an obtained average coherence value.

However, in the technique of Japanese Unexamined Patent Application Publication No. 2013-061421, in a case in which two non-directional microphones are used, a phase difference is hardly generated in a low frequency component, in particular, and accuracy is reduced.

SUMMARY OF THE INVENTION

In view of the foregoing, an object of a preferred embodiment of the present invention is to provide a sound pickup device and a sound pickup method that are able to reduce distant noise with higher accuracy than conventionally.

A sound pickup device includes a directional first microphone, a non-directional second microphone, and a level controller. The level controller obtains a correlation between a first sound pickup signal of the first microphone and a second sound pickup signal of the second microphone, and performs level control of the first sound pickup signal or the second sound pickup signal according to a calculation result of the correlation.

According to a preferred embodiment of the present invention, distant noise is able to be reduced with higher accuracy than conventionally.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A sound pickup device according to the present preferred embodiment of the present invention includes a directional first microphone, a non-directional second microphone, and a level controller. The level controller obtains a correlation between a first sound pickup signal of the first microphone and a second sound pickup signal of the second microphone. The level controller performs level control of the first sound pickup signal or the second sound pickup signal according to a calculation result of the correlation.

As with Japanese Unexamined Patent Application Publication No. 2013-061421, in a case in which two non-directional microphones and a first directivity former 11 are used, it is expected that sound arriving from the direction at the angle of θ is reduced. However, in Japanese Unexamined Patent Application Publication No. 2013-061421, it is necessary that the sensitivity of the microphones matches and no error occurs in the installation positions of the microphones. In particular, since a phase difference hardly occurs in a low frequency component, and a signal after directivity formation becomes very small. Therefore, the accuracy is easily reduced according to difference in the sensitivities or an error in the arrangement positions and the like of the microphones.

In addition, distant sound has a large number of reverberant sound components, and is a sound of which an arrival direction is not fixed. A directional microphone picks up sound in a specific direction with high sensitivity. A non-directional microphone picks up sound from all directions with equal sensitivity. In other words, the directional microphone and the non-directional microphone are greatly different in sound pickup capability to distant sound. The sound pickup device uses a directional first microphone and a non-directional second microphone, so that, when sound from a distant sound source is inputted, the correlation between the first sound pickup signal and the second sound pickup signal is reduced. Therefore, when sound from a sound source near the device is inputted, a correlation value is increased. In such a case, since the directivity itself of a microphone differs in each frequency, even when a low frequency component in which a phase difference hardly occurs is inputted, for example, the correlation is reduced in a case of the distant sound source and it is less susceptible to the effect of an error such as a difference in the sensitivities or placement of the microphones.

Therefore, the sound pickup device is able to stably and highly accurately emphasize the sound from a sound source near the device and is able to reduce distant noise.

Figure 1:
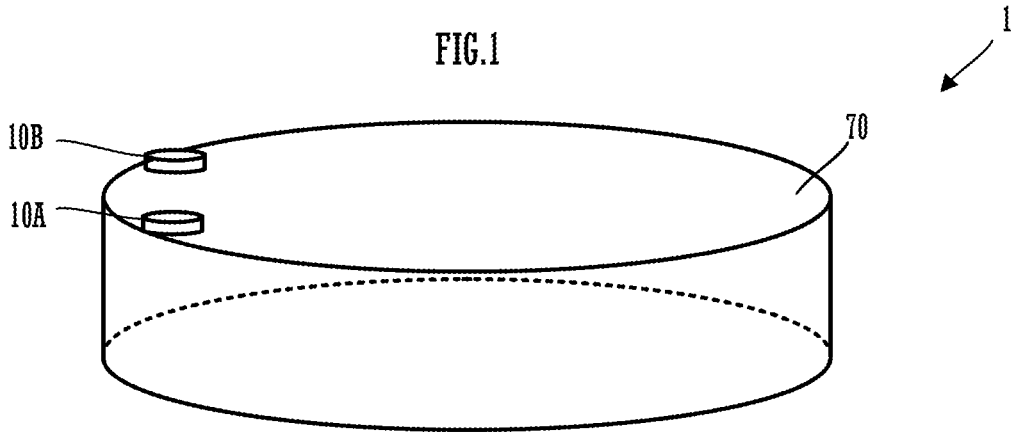
FIG. 1 is a schematic view showing a configuration of a sound pickup device 1.

FIG. 1 is an external schematic view showing a configuration of a sound pickup device 1. In FIG. 1, the main configuration according to sound pickup is described and other configurations are not described. The sound pickup device 1 includes a cylindrical housing 70, a microphone 10A, and a microphone 10B.

The microphone 10A and the microphone 10B are disposed on an upper surface of the housing 70. However, the shape of the housing 70 and the placement of the microphones are merely examples and are not limited to these examples.

Figure 2:
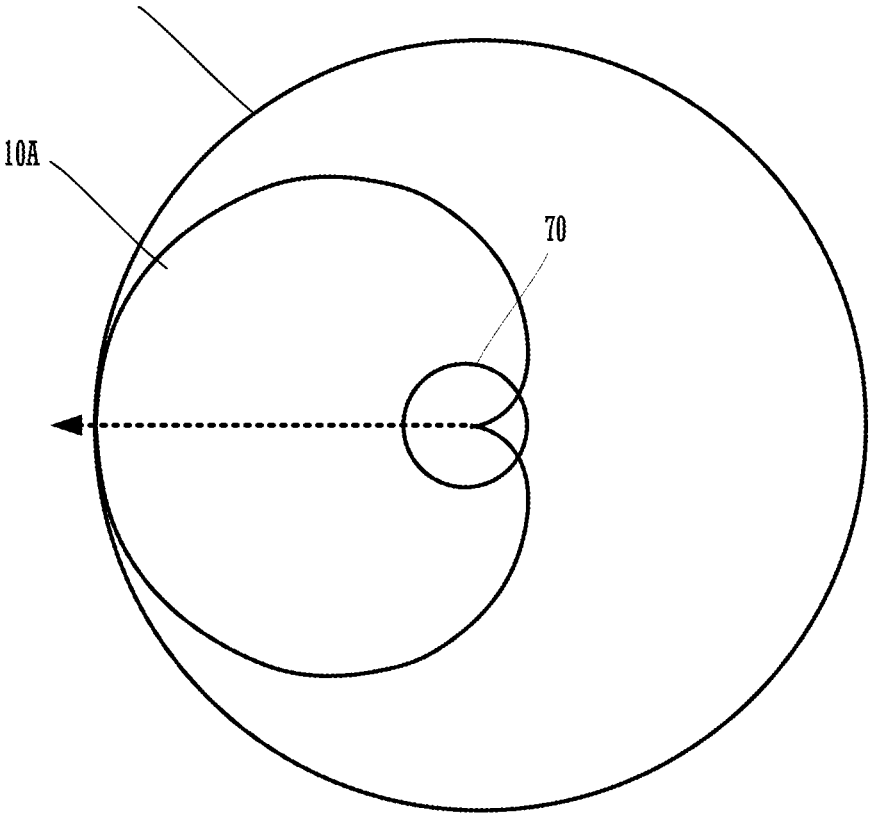
FIG. 2 is a plan view showing directivity of a microphone 10A and a microphone 10B.

FIG. 2 is a plan view showing directivity of the microphone 10A and the microphone 10B. As shown in FIG. 2, the microphone 10A is a directional microphone having the highest sensitivity in front (the left direction in the figure) of the device and having no sensitivity in back (the right direction in the figure) of the device. The microphone 10B is a non-directional microphone having uniform sensitivity in all directions.

Figure 3:
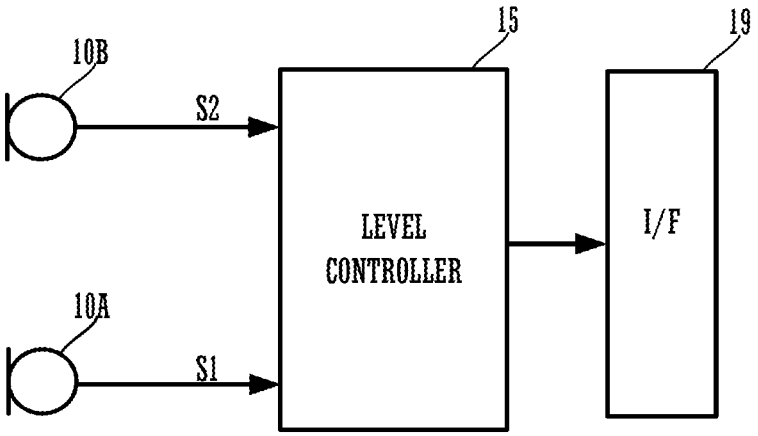
FIG. 3 is a block diagram showing a configuration of the sound pickup device 1.

FIG. 3 is a block diagram showing a configuration of the sound pickup device 1. The sound pickup device 1 includes the microphone 10A, the microphone 10B, a level controller 15, and an interface (I/F) 19.

The level controller 15 receives an input of a sound pickup signal S1 of the microphone 10A and a sound pickup signal S2 of the microphone 10B. The level controller 15 performs level control of the sound pickup signal S1 of the microphone 10A or the sound pickup signal S2 of the microphone 10B, and outputs the signal to the I/F 19.

Figure 4:
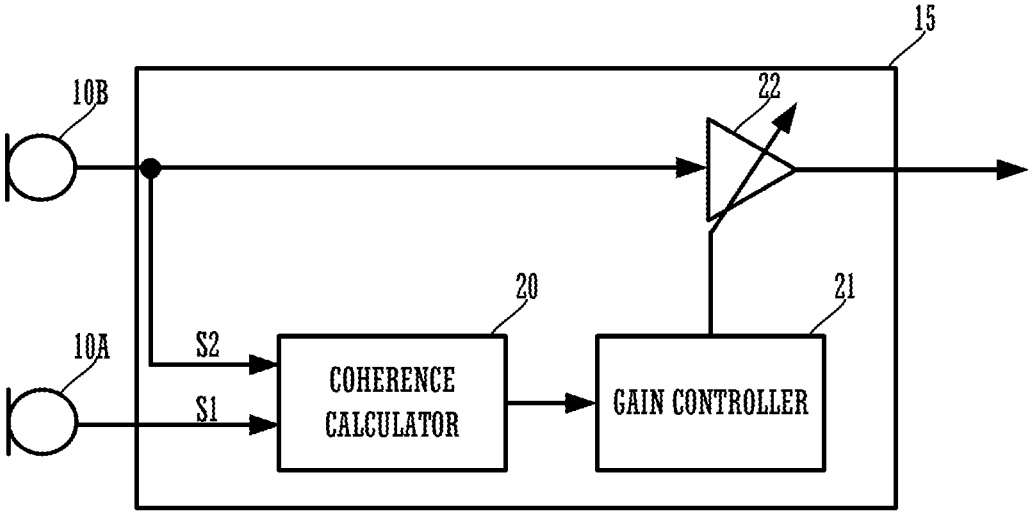
FIG. 4 is a view showing an example of a configuration of a level controller 15.
Figure 10:
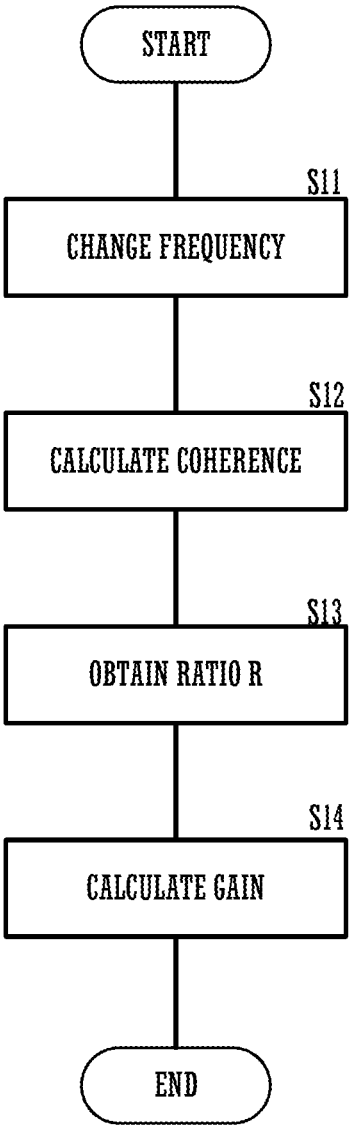
FIG. 10 is a flow chart showing an operation of the level controller 15.

FIG. 4 is a view showing an example of a configuration of the level controller 15. FIG. 10 is a flow chart showing an operation of the level controller 15. The level controller 15 includes a coherence calculator 20, a gain controller 21, and a gain adjuster 22. It is to be noted that functions of the level controller 15 are also able to be achieved by a general information processing apparatus such as a personal computer. In such a case, the information processing apparatus achieves the functions of the level controller 15 by reading and executing a program stored in a storage medium such as a flash memory.

The coherence calculator 20 receives an input of the sound pickup signal S1 of the microphone 10A and the sound pickup signal S2 of the microphone 10B. The coherence calculator 20 calculates coherence of the sound pickup signal S1 and the sound pickup signal S2 as an example of correlation.

The gain controller 21 determines a gain of the gain adjuster 22, based on a calculation result of the coherence calculator 20. The gain adjuster 22 receives an input of the sound pickup signal S2. The gain adjuster 22 adjusts a gain of the sound pickup signal S2, and outputs the adjusted signal to the I/F 19.

It is to be noted that, while the gain of the sound pickup signal S2 of the microphone 10B is adjusted and the adjusted signal is outputted to the I/F 19 in this example, a gain of the sound pickup signal S1 of the microphone 10A may be adjusted and the adjusted signal may be outputted to the I/F 19. However, the microphone 10B as a non-directional microphone is able to pick up sound of the whole surroundings. Therefore, it is preferable to adjust the gain of the sound pickup signal S2 of the microphone 10B, and to output the adjusted signal to the I/F 19.

The coherence calculator 20 applies the Fourier transform to each of the sound pickup signal S1 and the sound pickup signal S2, and converts the signals into a signal X(f, k) and a signal Y(f, k) of a frequency axis (S11). The "f" represents a frequency and the "k" represents a frame number. The coherence calculator 20 calculates coherence (a time average value of the complex cross spectrum) according to the following Expression 1 (S12).

Expression 1

$$\gamma^2(f,k) = \frac{|C_{xy}(f,k)|^2}{P_x(f,k)P_y(f,k)}$$

$$C_{xy}(f,k) = (1-\alpha)C_{xy}(f,k-1) + \alpha X(f,k)Y(f,k)^*$$

$$P_x(f,k) = (1-\alpha)P_x(f,k-1) + \alpha|X(f,k)|^2$$

$$P_y(f,k) = (1-\alpha)P_y(f,k-1) + \alpha|Y(f,k)|^2$$

However, the expression 1 is an example. For example, the coherence calculator 20 may calculate the coherence according to the following Expression 2 or Expression 3.

Expression 2

$$\gamma^2(f, mT+k) = \frac{\left|\frac{1}{T}\sum_{0\le l<T} X(f,(m-1)T+l)Y(f,(m-1)T+l)^*\right|^2}{\left(\frac{1}{T}\sum_{0\le l<T}|X(f,(m-1)T+l)|^2\right)\left(\frac{1}{T}\sum_{0\le l<T}|Y(f,(m-1)T+l)|^2\right)}$$

Expression 3

$$\gamma^2(f,k) = \frac{\left|\frac{1}{T}\sum_{0\le l<T} X(f,k-l)Y(f,k-l)^*\right|^2}{\left(\frac{1}{k}\sum_{0\le l<T}|X(f,k-l)|^2\right)\left(\frac{1}{k}\sum_{0\le l<T}|Y(f,k-l)|^2\right)}$$

It is to be noted that the "m" represents a cycle number (an identification number that represents a group of signals including a predetermined number of frames) and the "T" represents the number of frames of 1 cycle.

The gain controller 21 determines the gain of the gain adjuster 22, based on the coherence. For example, the gain controller 21 obtains a ratio R(k) of a frequency bin of which the amplitude of coherence exceeds a predetermined threshold value γth, with respect to all frequencies (the number of frequency bins) (S13).

Expression 4

$$R(k) = \frac{Count_{f_0\le f\le f_1}\{\gamma^2(f,k) > \gamma_{th}^2\}}{f_1 - f_0} : MSC \text{ Rate}$$

The threshold value γth is set to γth=0.6, for example. It is to be noted that f0 in the Expression 4 is a lower limit frequency bin, and f1 is an upper limit frequency bin.

Figure 5A:
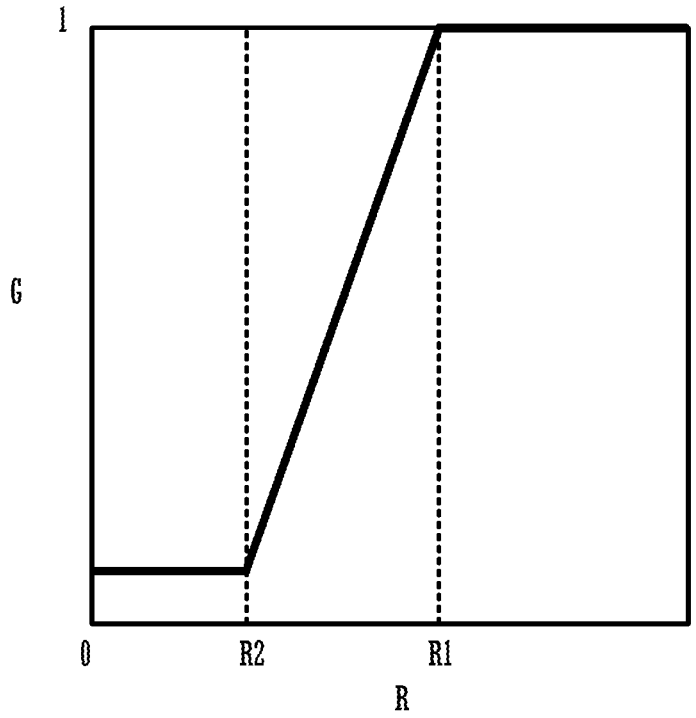
FIG. 5A is a view showing an example of a gain table.

The gain controller 21 determines the gain of the gain adjuster 22 according to this ratio R(k) (S14). More specifically, the gain controller 21 determines whether or not coherence exceeds a threshold value γth for each frequency bin. Then, the gain controller 21 totals the number of frequency bins that exceed the threshold value, and determines a gain according to a total result. FIG. 5A is a view showing an example of a gain table. According to the gain table in the example shown in FIG. 5A, the gain controller 21 does not attenuate the gain when the ratio R is equal to or greater than a predetermined value R1 (gain=1). The gain controller 21 sets the gain to be attenuated as the ratio R is reduced when the ratio R is from the predetermined value R1 to a predetermined value R2. The gain controller 21 maintains the minimum gain value when the ratio R is less than R2. The minimum gain value may be 0 or may be a value that is slightly greater than 0, that is, a state in which sound is able to be heard very slightly. Accordingly, a user does not misunderstand that sound has been interrupted due to a failure or the like.

Coherence shows a high value when the correlation between two signals is high. Distant sound has a large number of reverberant sound components, and is a sound of which an arrival direction is not fixed. The directional microphone 10A and the non-directional microphone 10B according to the present preferred embodiment are greatly different in sound pickup capability to distant sound. Therefore, coherence is reduced in a case in which sound from a distant sound source is inputted, and is increased in a case in which sound from a sound source near the device is inputted.

Therefore, the sound pickup device 1 does not pick up sound from a sound source far from the device, and is able to emphasize sound from a sound source near the device as a target sound.

It is to be noted that the example shows that the gain controller 21 obtains the ratio R(k) of a frequency of which the coherence exceeds a predetermined threshold value γth, with respect to all frequencies and performs gain control according to the ratio. However, for example, the gain controller 21 may obtain an average of coherence and may perform the gain control according to the average. However, since nearby sound and distant sound include at least a reflected sound, coherence of a frequency may be extremely reduced. When such an extremely low value of coherence is included, the average may be reduced. The ratio R(k) only affects how many frequency components that are equal to or greater than a threshold value are present, and whether the value itself of the coherence that is less than a threshold value is a low value or a high value does not affect gain control at all. Therefore, the sound pickup device 1, by performing the gain control according to the ratio R(k), is able to reduce distant noise and is able to emphasize a target sound with high accuracy.

It is to be noted that, although the predetermined value R1 and the predetermined value R2 may be set to any value, the predetermined value R1 is preferably set according to the maximum range in which sound is desired to be picked up without being attenuated. For example, in a case in which the position of a sound source is farther than about 30 cm in radius and a value of the ratio R of coherence is thus reduced, a distance is about 40 cm. The sound pickup device 1, by setting a value of the ratio R at this time to the predetermined value R1, is able to pick up sound without attenuating up to a distance of about 40 cm in radius. In addition, the predetermined value R2 is set according to the minimum range in which sound is desired to be attenuated. For example, the sound pickup device 1 sets a value of the ratio R when a distance is 100 cm to the predetermined value R2, so that sound is hardly picked up when a distance is equal to or greater than 100 cm while sound is picked up as the gain is gradually increased when a distance is closer to 100 cm.

In addition, the predetermined value R1 and the predetermined value R2 may not be fixed values, and may dynamically be changed. For example, the level controller 15 obtains an average value R0 (or the greatest value) of the ratio R obtained in the past within a predetermined time, and sets the predetermined value R1=R0+0.1 and the predetermined value R2=R0−0.1. As a result, with reference to a position of the current sound source, sound in a range closer to the position of the sound source is picked up and sound in a range farther than the position of the sound source is not picked up.

Figure 5B:
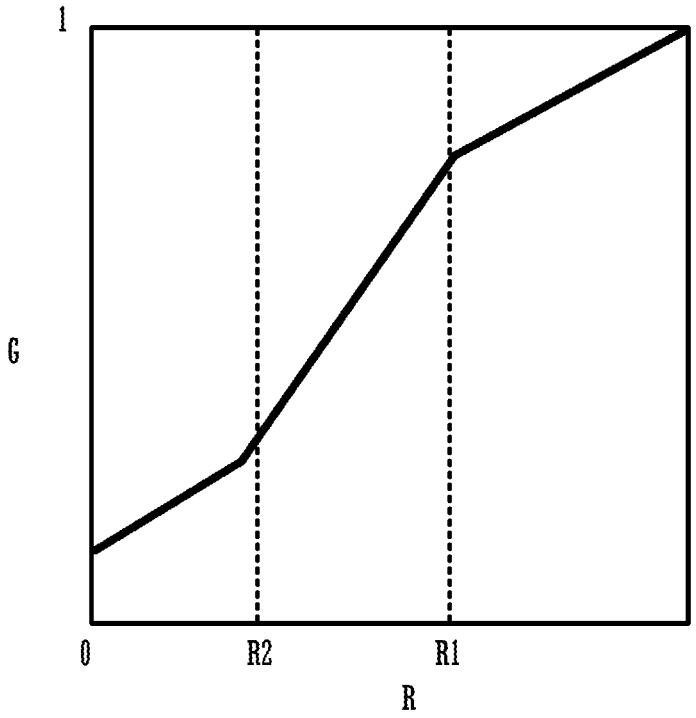
FIG. 5B is a view showing an example of a gain table different from FIG. 5A.

It is to be noted that the example of FIG. 5A shows that the gain is drastically reduced from a predetermined distance (30 cm, for example) and sound from a sound source beyond a predetermined distance (100 cm, for example) is hardly picked up, which is similar to the function of a limiter. However, the gain table, as shown in FIG. 5B, also shows various examples. In the example of FIG. 5B, the gain is gradually reduced according to the ratio R, the reduction degree of the gain is increased from the predetermined value R1. In the example of FIG. 5B, the gain is again gradually reduced at the predetermined value R2 or less, which is similar to the function of a compressor.

Figure 6:
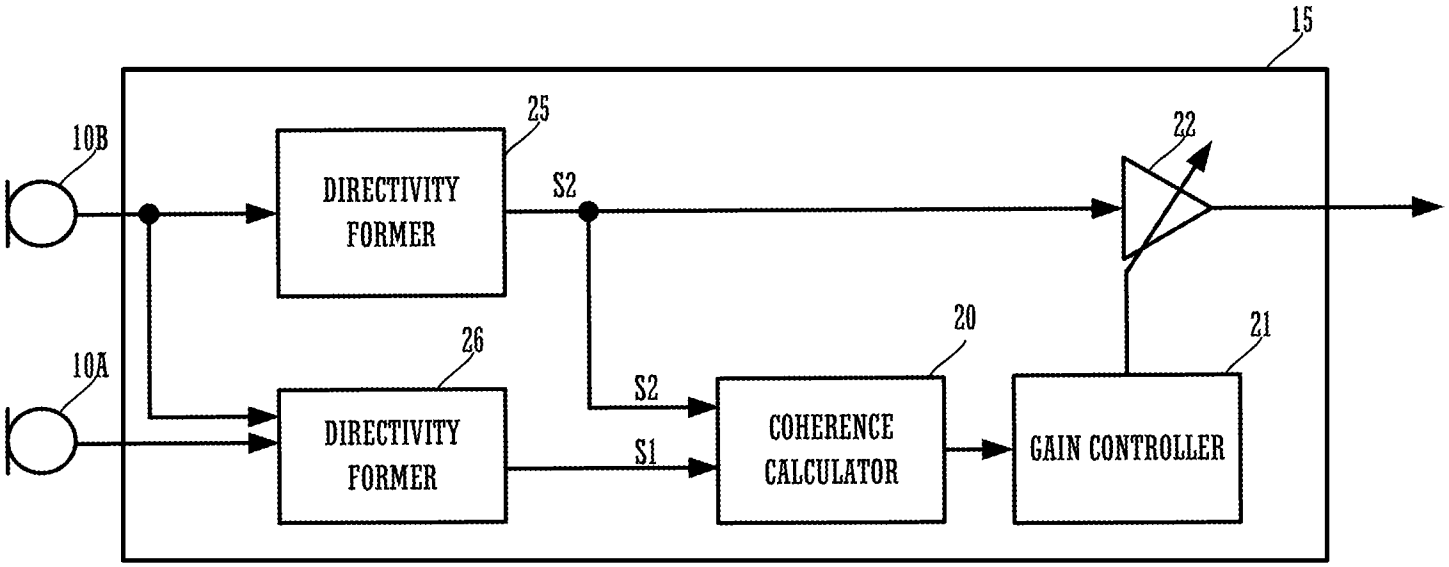
FIG. 6 is a view showing a configuration of a level controller 15 according to Modification 1.
Figure 7A:
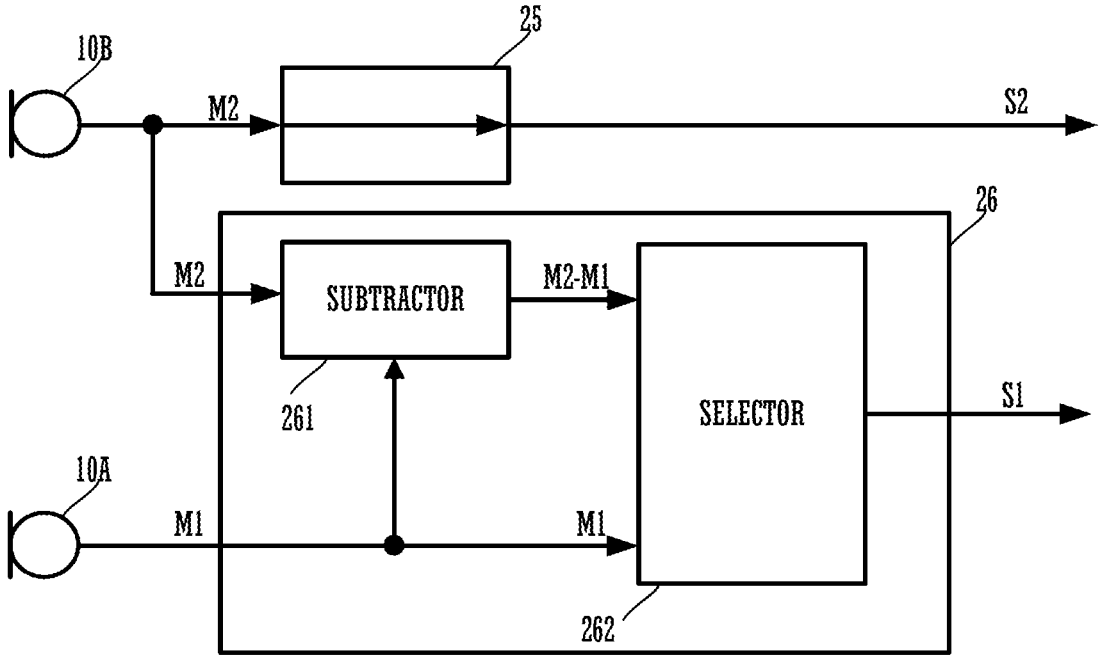
FIG. 7A is a block diagram showing a functional configuration of a directivity former 25 and a directivity former 26.
Figure 11:
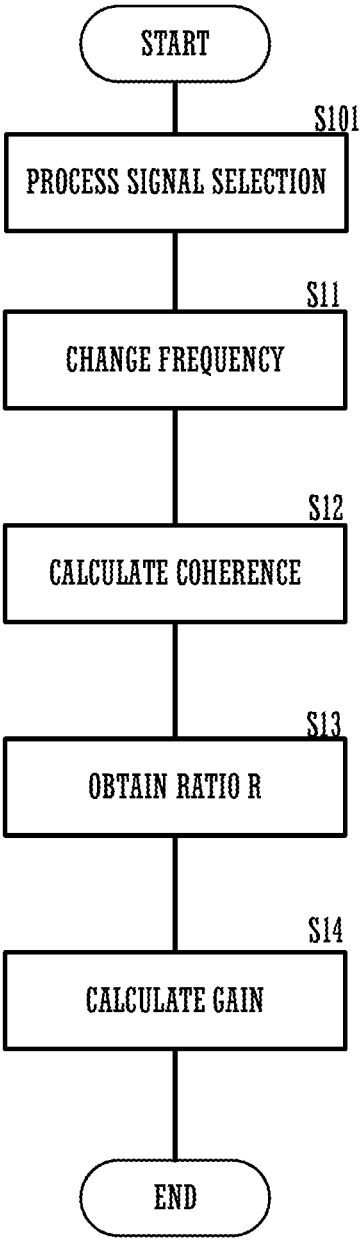
FIG. 11 is a flow chart showing an operation of the level controller 15 according to Modification.

Subsequently, FIG. 6 is a view showing a configuration of a level controller 15 according to Modification 1. The level controller 15 includes a directivity former 25 and a directivity former 26. FIG. 11 is a flow chart showing an operation of the level controller 15 according to Modification 1. FIG. 7A is a block diagram showing a functional configuration of the directivity former 25 and the directivity former 26.

The directivity former 25 outputs an output signal M2 of the microphone 10B as the sound pickup signal S2 as it is. The directivity former 26, as shown in FIG. 7A, includes a subtractor 261 and a selector 262.

The subtractor 261 obtains a difference between an output signal M1 of the microphone 10A and the output signal M2 of the microphone 10B, and inputs the difference into the selector 262.

Figure 7B:
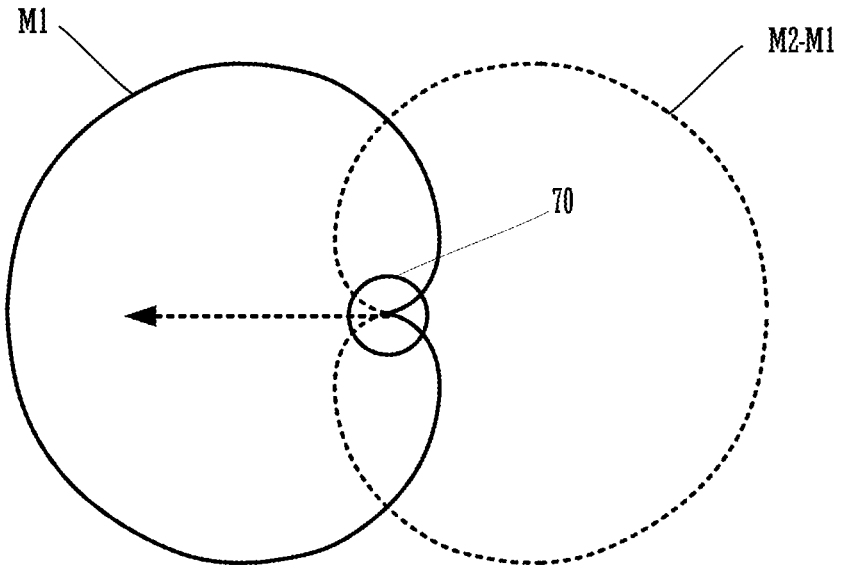
FIG. 7B is a plan view showing directivity.

The selector 262 compares a level of the output signal M1 of the microphone 10A and a level of a difference signal obtained from the difference between the output signal M1 of the microphone 10A and the output signal M2 of the microphone 10B, and outputs a signal at a higher level as the sound pickup signal S1 (S101). As shown in FIG. 7B, the difference signal obtained from the difference between the output signal M1 of the microphone 10A and the output signal M2 of the microphone 10B has the reverse directivity of the microphone 10B.

In this manner, the level controller 15 according to Modification 1, even when using a directional microphone (having no sensitivity to sound in a specific direction), is able to provide sensitivity to the whole surroundings of the device. Even in this case, the sound pickup signal S1 has directivity, and the sound pickup signal S2 has non-directivity, which makes sound pickup capability to distant sound differ. Therefore, the level controller 15 according to Modification 1, while providing sensitivity to the whole surroundings of the device, does not pick up sound from a sound source far from the device, and is able to emphasize sound from a sound source near the device as a target sound.

Figure 8:
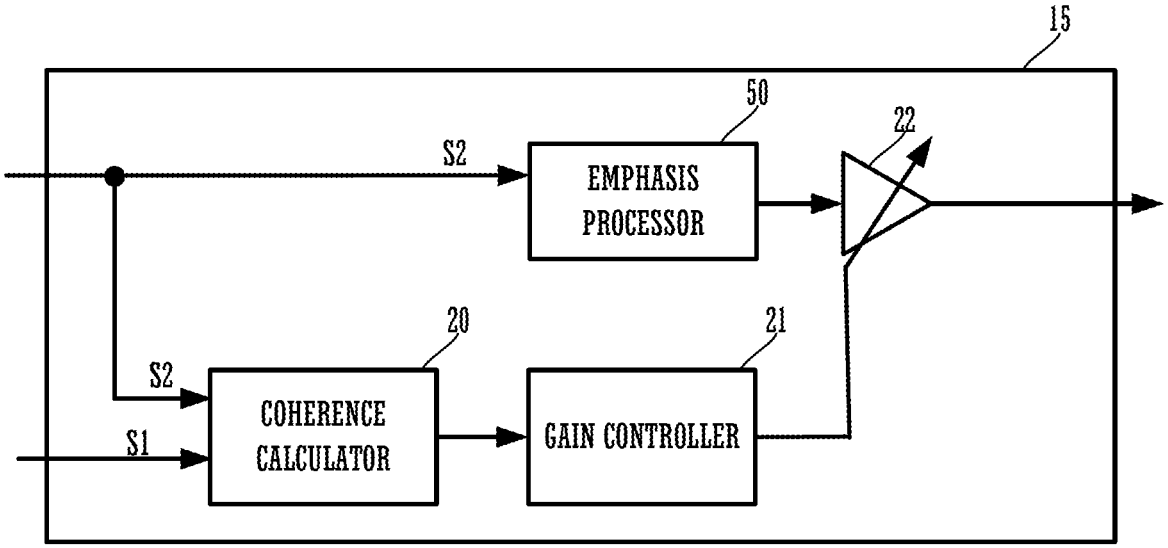
FIG. 8 is a view showing a configuration of a level controller 15 according to Modification 2.

Subsequently, FIG. 8 is a view showing a configuration of a level controller 15 according to Modification 2. The level controller 15 includes an emphasis processer 50. The emphasis processer 50 receives an input of a sound pickup signal S1, and performs processing to emphasize a target sound (sound of the voice that a speaker near the device has uttered). The emphasis processer 50, for example, estimates a noise component, and emphasizes a target sound by reducing a noise component by the spectral subtraction method using the estimated noise component.

Figure 9:
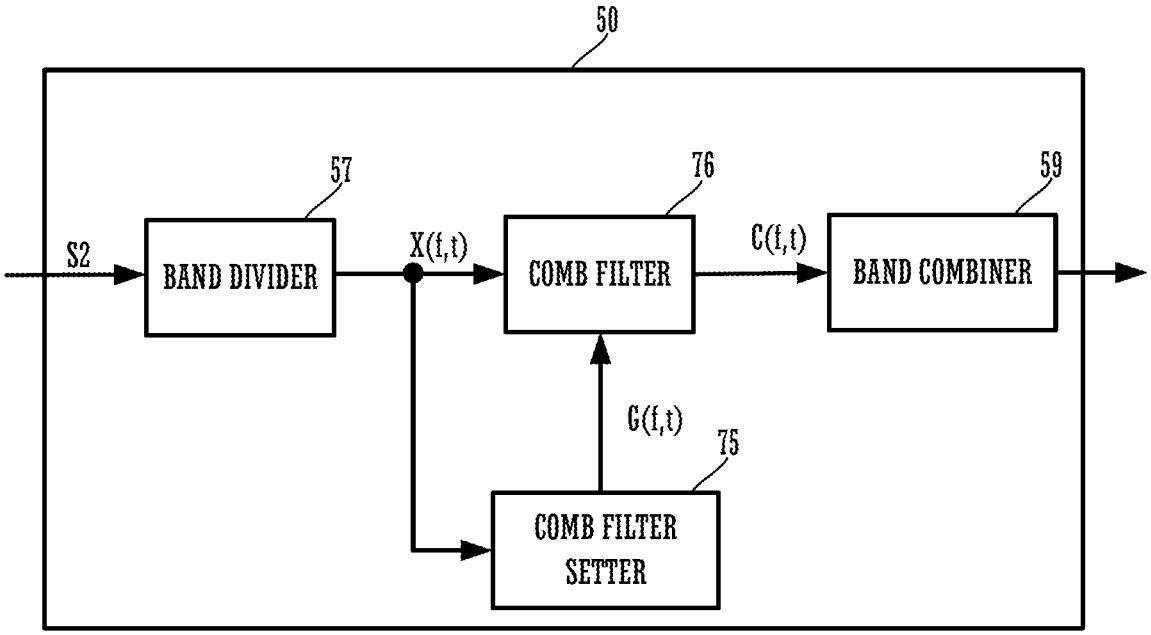
FIG. 9 is a block diagram showing a functional configuration of an emphasis processer 50.

Alternatively, the emphasis processer 50 may perform emphasis processing shown below. FIG. 9 is a block diagram showing a functional configuration of the emphasis processer 50. A band divider 57 applies the Fourier transform to the sound pickup signal S2, and converts the signal into a signal X(f, t) of a frequency axis. A band combiner 59 performs processing to convert an output signal C(f, t) of the comb filter 76 back into a signal of a time axis.

Human voice has a harmonic structure having a peak component for each predetermined frequency. Therefore, the comb filter setter 75, as shown in the following Expression 5, passes the peak component of human voice, obtains a gain characteristic G(f, t) of reducing components except the peak component, and sets the obtained gain characteristic as a gain characteristic of the comb filter 76.

$$z(c, t) = DFT_{f\to c}\{\log|X(f, t)|\} \qquad \text{Expression 5}$$

$$c_{peak}(t) = \text{argmax}_c\{z(c, t)\}$$

$$z_{peak}(c, t) = \begin{cases} z(c_{peak}(t), t) & (c = c_{peak}(t)) \\ 0 & \text{otherwise} \end{cases}$$

$$G(f, t) = \begin{cases} IDFT_{c\to f}\{\exp(z_{peak}(c, t))\} & (F_0 < f < F_1) \\ 1 & \text{otherwise} \end{cases}$$

$$C(f, t) = G(f, t)^{\eta} Z(f, t)$$

In other words, the comb filter setter 75 applies the Fourier transform to the sound pickup signal S2, and further applies the Fourier transform to a logarithmic amplitude to obtain a cepstrum z(c, t). The comb filter setter 75 extracts a value of c, that is, $c_{peak}$=argmax$_c$ {z(c, t)} that maximizes this cepstrum z (c, t). The comb filter setter 75, in a case in which the value of c is other than $c_{peak}$(t) and neighborhood of $c_{peak}$(t), extracts the peak component of the cepstrum as a cepstrum value z(c, t)=0. The comb filter setter 75 converts this peak component $z_{peak}$(c, t) back into a signal of the frequency axis, and sets the signal as the gain characteristic G(f, t) of the comb filter 76. As a result, the comb filter 76 serves as a filter that emphasizes a harmonic component of human voice.

It is to be noted that the gain controller 21 may adjust the intensity of the emphasis processing by the comb filter 76, based on a calculation result of the coherence calculator 20. For example, the gain controller 21, in a case in which the value of the ratio R(k) is equal to or greater than the predetermined value R1, turns on the emphasis processing by the comb filter 76. The gain controller 21, in a case in which the value of the ratio R(k) is less than the predetermined value R1, turns off the emphasis processing by the comb filter 76. In such a case, the emphasis processing by the comb filter 76 is also included in one aspect in which the level control of the sound pickup signal S2 (or the sound pickup signal S1) is performed according to the calculation result of the correlation. Therefore, the sound pickup device 1 may perform only emphasis processing on a target sound by the comb filter 76.

It is to be noted that the level controller 15, for example, may estimate a noise component. Accordingly, the level controller 15 may perform processing to emphasize a target sound by reducing a noise component by the spectral subtraction method using the estimated noise component. Furthermore, the level controller 15 may adjust the intensity of noise reduction processing based on the calculation result of the coherence calculator 20. For example, the level controller 15, in a case in which the value of the ratio R(k) is equal to or greater than the predetermined value R1, turns on the emphasis processing by the noise reduction processing. The level controller 15, in a case in which the value of the ratio R(k) is less than the predetermined value R1, turns off the emphasis processing by the noise reduction processing. In such a case, the emphasis processing by the noise reduction processing is also included in one aspect in which the level control of the sound pickup signal S2 (or the sound pickup signal S1) is performed according to the calculation result of the correlation.

Finally, the foregoing preferred embodiments are illustrative in all points and should not be construed to limit the present invention. The scope of the present invention is defined not by the foregoing preferred embodiment but by the following claims. Further, the scope of the present invention is intended to include all modifications within the scopes of the claims and within the meanings and scopes of equivalents.

What is claimed is:

1. A sound pickup device comprising:
a directional first microphone;
a non-directional second microphone; and
a level controller that:
obtains a first sound pickup signal to be generated from the first microphone and a second sound pickup signal to be generated from the second; microphone
converts the first sound pickup signal and the second sound pickup signal into a first frequency signal and a second frequency signal;
calculates a coherence between the first frequency signal and the second frequency signal;
calculates a ratio of a frequency component of which the calculated coherence exceeds a first threshold value with respect to all frequency components; and
controls a level of the first sound pickup signal or the second sound pickup signal according to the calculated ratio.

2. The sound pickup device according to claim 1, wherein the level controller includes a selector that selects as the first sound pickup signal a higher level signal of either an output signal of the first microphone and a difference signal by subtracting the output signal of the first microphone from the output signal of the second microphone.

3. The sound pickup device according to claim 1, wherein the level controller estimates a noise component, and, as the level control, performs processing to reduce the estimated noise component from the first sound pickup signal or the second sound pickup signal.

4. The sound pickup device according to claim 3, wherein the level controller turns on or off the processing to reduce the noise component according to the calculated ratio.

5. The sound pickup device according to claim 1, wherein the level controller includes a comb filter that reduces a harmonic component on a basis of human voice.

6. The sound pickup device according to claim 5, wherein the level controller turns on or off processing by the comb filter according to the calculated ratio.

7. The sound pickup device according to claim 1, wherein the level controller includes a gain controller that controls a gain of the first sound pickup signal or the second sound pickup signal.

8. The sound pickup device according to claim 7, wherein the level controller changes the gain of the gain controller based on the calculated ratio.

9. The sound pickup device according to claim 8, wherein the level controller attenuates the gain according to the calculated ratio in a case in which the calculated ratio is less than a first threshold value.

10. The sound pickup device according to claim 9, wherein the first threshold value is determined based on the calculated ratio calculated within a predetermined time.

11. The sound pickup device according to claim 8, wherein the level controller sets the gain as a minimum gain in a case in which the calculated ratio is less than a second threshold value.

12. The sound pickup device according to claim 1, wherein the level controller determines whether or not the coherence exceeds the threshold value for each frequency, obtains the ratio of the frequency component as a total result obtained by totaling a number of frequencies that exceed the threshold value, and performs the level control according to the total result.

13. A sound pickup method comprising:

obtaining a first sound pickup signal of a directional first microphone and a second sound pickup signal of a non-directional second microphone;

converting the first sound pickup signal and the second sound pickup signal into a first frequency signal and a second frequency signal;

calculating a coherence between the first frequency signal and the second frequency signal;

calculating a ratio of a frequency component of which the calculated coherence exceeds a first threshold value with respect to all frequency components;

and controlling a level of the first sound pickup signal or the second sound pickup signal according to the calculated ratio.

14. The sound pickup method according to claim 13, further comprising selecting as the first sound pickup signal a higher level signal of either an output signal of the first microphone and a difference signal by subtracting the output signal of the first microphone from the output signal of the second microphone.

15. The sound pickup method according to claim 13, further comprising estimating a noise component, and, as the level control, performing processing to reduce the estimated noise component from the first sound pickup signal or the second sound pickup signal.

16. The sound pickup method according to claim 15, further comprising turning on or off the processing to reduce the noise component according to the calculated coherence.

17. The sound pickup method according to claim 13, wherein a comb filter that reduces a harmonic component on a basis of human voice is used.

18. The sound pickup method according to claim 17, further comprising turning on or off processing by the comb filter according to the calculated coherence.

19. A sound pickup device comprising:

a directional first microphone;

a non-directional second microphone; and at least one memory device that stores instructions; and at least one processor that executes the instructions, wherein the instructions cause the processor to perform:

obtaining a first sound pickup signal to be generated from the first microphone and a second sound pickup signal to be generated from the second microphone;

converting the first sound pickup signal and the second sound pickup signal into a first frequency signal and a second frequency signal;

calculating a coherence between the first frequency signal and the second frequency signal;

calculating a ratio of a frequency component of which the calculated coherence exceeds a first threshold value with respect to all frequency components; and controlling a level of the first sound pickup signal or the second sound pickup signal according to the calculated ratio.

* * * * *